US007254968B2

(12) United States Patent
Kim et al.

(10) Patent No.: US 7,254,968 B2
(45) Date of Patent: Aug. 14, 2007

(54) TUB ASSEMBLY IN DRUM-TYPE WASHING MACHINE

(75) Inventors: Kwang Soo Kim, Changwon-si (KR); Jae Moon Kim, Jinhae-si (KR); Sam Je Park, Gimhae-si (KR); Hyun Jae Lee, Jinju-si (KR)

(73) Assignee: LG Electronics Inc., Seoul (KR)

( * ) Notice: Subject to any disclaimer, the term of this patent is extended or adjusted under 35 U.S.C. 154(b) by 451 days.

(21) Appl. No.: 10/670,786

(22) Filed: Sep. 26, 2003

(65) Prior Publication Data

US 2004/0148981 A1 Aug. 5, 2004

(51) Int. Cl.
*D06F 37/04* (2006.01)

(52) U.S. Cl. ..... 68/24; 68/140; 68/142

(58) Field of Classification Search ..... 68/24, 68/140, 142

See application file for complete search history.

(56) References Cited

U.S. PATENT DOCUMENTS 5,862,686 A * 1/1999 Skrippek ..... 68/140
5,894,746 A * 4/1999 Skrippek ..... 68/140
6,148,647 A * 11/2000 Kabeya et al. ..... 68/140
6,474,114 B1 * 11/2002 Ito et al. ..... 68/140
6,510,716 B1 * 1/2003 Kim et al. ..... 68/24
6,557,383 B1 * 5/2003 Ito et al. ..... 68/23.2
6,564,594 B1 * 5/2003 Ito et al. ..... 68/24

FOREIGN PATENT DOCUMENTS

EP 1094144 A2 * 4/2001

* cited by examiner

*Primary Examiner*—Joseph L. Perrin
(74) *Attorney, Agent, or Firm*—McKenna Long & Aldridge LLP

(57) ABSTRACT

A tub assembly in a drum-type washing machine includes a tub body having a cylindrical shape forming front and rear edge portions; a ring-type tub cover coupled with the front edge portion of the tub body; a tub back, coupled with the rear edge portion of the tub body, comprised of an outer circumference wall extending horizontally to a predetermined distance with respect to an outer circumference of a circular panel forming a recessed space, the outer circumference wall in tight contact with the rear edge portion of the tub body; and a motor assembly loaded at the recessed space. The tub assembly enables a reduction in tub size and weight, by devising a construction that obviates the need for a bracket for fixing a bearing housing to a tub back and this minimizing a rearward protrusion of the bearing housing and tub back.

4 Claims, 6 Drawing Sheets

RELATED ART FIG. 1

TUB ASSEMBLY IN DRUM-TYPE WASHING MACHINE

This application claims the benefit of the Korean Application No. 10-2002-0058519 filed on Sep. 26, 2002, which is hereby incorporated by reference.

BACKGROUND OF THE INVENTION

1. Field of the Invention

The present invention relates to a tub assembly in a drum-type washing machine, in which a bracket fixing a bearing housing is eliminated so that a motor assembly can be installed in an interior space created at the rear of the tub.

2. Discussion of the Related Art

Generally speaking, laundering using a drum-type washing machine is carried out using a frictional force between the laundry and a rotating drum that receives the driving force of a motor. Such a method causes little damage to the laundry, prevents the laundry from getting tangled, and achieves such washing effects as beating and rubbing.

FIG. 1 illustrates a drum-type washing machine according to a related art, in which the motor is installed below the drum.

Referring to FIG. 1, a cylindrical tub 2 made of stainless steel is installed inside a cabinet 1, and a cylindrical drum 3 is rotatably installed inside the tub. A motor 15 is mounted on one lower side of the tub 2, and a motor pulley 151 is connected to the motor. A drum shaft 31 is installed at a rear side of the drum 3, and a drum pulley 32 is installed at the rearward end of the drum shaft. The drum pulley 32 is rotatably coupled, via a belt 16, to the motor pulley 151.

To support the tub 2, a suspension spring 24 is installed between an inner face of an upper side of the cabinet 1 and an upper side of the tub's outer circumference. A friction damper 25 is installed between an inner side of a lower surface of the cabinet 1 and a lower side of the outer circumference of the tub 2, to attenuate shaking of the tub upon dewatering.

The tub 2 consists of a tub cover 21 forming a front part of the tub, a tub body 22 forming a sidewall part of the tub, and a tub back 23 forming a rear part of the tub. The drum shaft 31 is assembled to a bearing housing 4, in which bearings 4*a* and 4*b* are installed, and the assembly is fixed to a central portion of the tub back 23.

Three coupling bridges 41 are integrally formed as one piece, with 120° of spacing between the bridges, to radiate outwardly from the bearing housing 4. The outer end of each coupling bridge 41 is fixed to a rear side of the tub body 22, via a fixing bracket 14 and a bolt 8, so as to be assembled to the tub back 23.

A counterweight 26 installed at a front side of the tub 2 counteracts a weight imbalance resulting from the tub back 23 being made of stainless steel and the motor 5 being mounted on its rear side.

The tub 2, which is made of stainless steel, is constructed by welding together the tub cover 21, tub body 22, and tub back 23. Then, the bearing housing 4 is assembled to the tub back 23, and the assembly is completed by coupling the drum shaft 31 and drum pulley 32.

In the above drum-type washing machine, the motor is installed below the tub and rotates the drum using the pulley. Another drum-type washing machine, however, uses a direct-coupled motor mounted on the rear side of the tub.

FIG. 2 illustrates a drum-type washing machine according to a related art, in which a direct-coupled motor is installed at a rear side of the tub, and FIG. 3 illustrates a tub body 22 and a tub back 23. Notably, a coupling structure of the tub back 23 is attached to the rear side of the tub 2.

Referring to FIGS. 2 and 3, the tub back 23 has an outer circumference wall 23*a* to enclose an outer rim of a tub 2. A rear edge of the tub body 22 is inserted inside the outer circumference wall 23*a*, and contacting portions are fixed by welding. The tub back 23 is welded to the periphery of the rear side of the tub 2, thereby enclosing the tub.

A motor assembly 6 is coupled to the tub back 23 at the center of a rear surface thereof. Specifically, the motor assembly 6 is coupled with the tub body 22 by a bearing housing 60 using a fixing bracket 62. The bearing housing 60 and fixing bracket 62 are radially installed at the 120° points with respect to the centrally installed motor assembly.

A plurality of bridges 61 radiate from the center of the bearing housing 60, with each bridge fixed to a periphery of the tub back 23. Specifically, each bridge 61 is coupled to a surface of the tub 2, either by welding or by a coupling member 62*a*, e.g., a bolt, such that the tub body 22, tub back 23, and bearing housing 60 are all fixed to the tub.

In the drum-type washing machine as shown in FIGS. 2 and 3, the tub back 23, having a diameter greater than that of the tub body 22, is attached to the rear side of the tub body, and the bracket 62 for assembling the tub body 22, tub back 23, and bearing housing 60 is also fixed to the rear side of the tub body 22, such that the congregate size and weight of the rear side of the tub assembly increases accordingly, which directly affects the size and weight of the drum-type washing machine as a whole. As a result, the manufacture of such a large and heavy product is cumbersome, the welding the fixing bracket 62 for fixing the tub back 23 and bearing housing 60 is time-consuming, and the overall product cost is increased to compensate for any inadequate welds.

SUMMARY OF THE INVENTION

Accordingly, the present invention is directed to a tub assembly in a drum-type washing machine that substantially obviates one or more problems due to limitations and disadvantages of the related art.

An object of the present invention is to provide a tub assembly in a drum-type washing machine, in which tub size and weight is reduced, by devising a construction that obviates the need for a bracket for fixing a bearing housing to a tub back and thus minimizing a rearward protrusion of the bearing housing and tub back.

It is another object of the present invention to provide a tub assembly of a drum-type washing machine, which obviates the need for a bracket for fixing a bearing housing to a tub back.

It is another object of the present invention to provide a tub assembly of a drum-type washing machine, which minimizes a rearward protrusion of the bearing housing and tub back.

It is another object of the present invention to provide a tub assembly of a drum-type washing machine, which facilitates the manufacture of a physically smaller drum-type washing-machine while maximizing capacity.

It is another object of the present invention to provide a tub assembly of a drum-type washing machine, which enables the manufacture of a drum-type washing-machine whose overall depth dimension is reduced.

It is another object of the present invention to provide a tub assembly of a drum-type washing machine, which enables the manufacture of a drum-type washing-machine having a tub assembly whose diameter and depth dimensions are both reduced.

It is another object of the present invention to provide a tub assembly of a drum-type washing machine, which simplifies the manufacture of a drum-type washing-machine.

It is another object of the present invention to provide a tub assembly of a drum-type washing machine, which reduces the assembly time of a drum-type washing-machine.

It is another object of the present invention to provide a tub assembly of a drum-type washing machine, which reduces manufacturing costs of a drum-type washing-machine.

It is another object of the present invention to provide a tub assembly of a drum-type washing machine, which facilitates the manufacture of a drum-type washing machine whose exterior has a clean appearance.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages and in accordance with the purpose of the invention, as embodied and broadly described herein, there is provided a tub assembly in a drum-type washing machine, comprising a tub body having a cylindrical shape forming front and rear edge portions; a ring-type tub cover coupled with the front edge portion of the tub body; a tub back, coupled with the rear edge portion of the tub body, comprised of an outer circumference wall extending horizontally to a predetermined distance with respect to an outer circumference of a circular panel forming a recessed space, the outer circumference wall in tight contact with the rear edge portion of the tub body; and a motor assembly loaded at the recessed space.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiment(s) of the present invention, examples of which are illustrated in the accompanying drawings. Throughout the drawings, like elements are indicated using the same or similar reference designations where possible.

Figure 1:
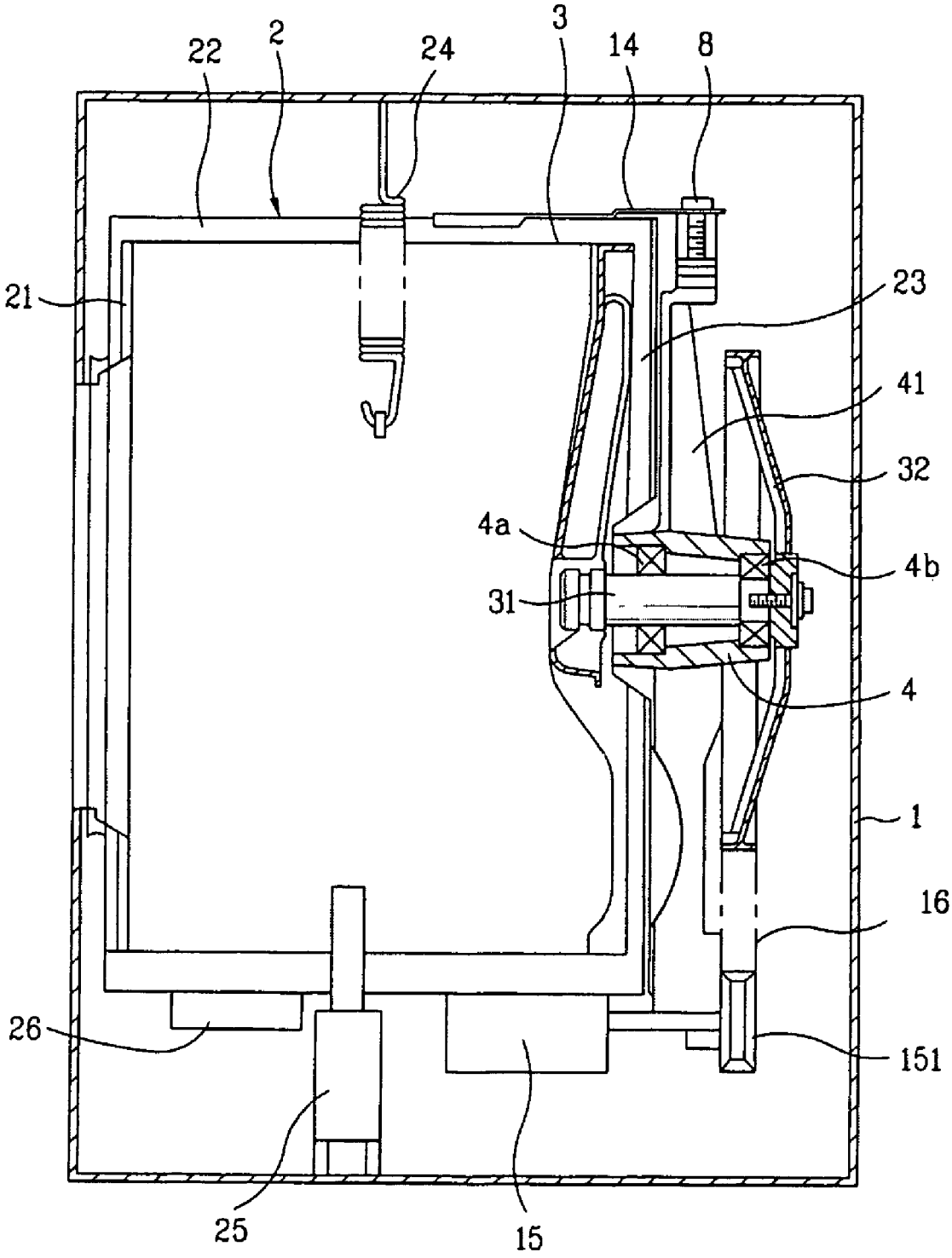
FIG. 1 is a cross-sectional view of a drum-type washing machine according to a related art, in which a motor is installed below the drum.
Figure 2:
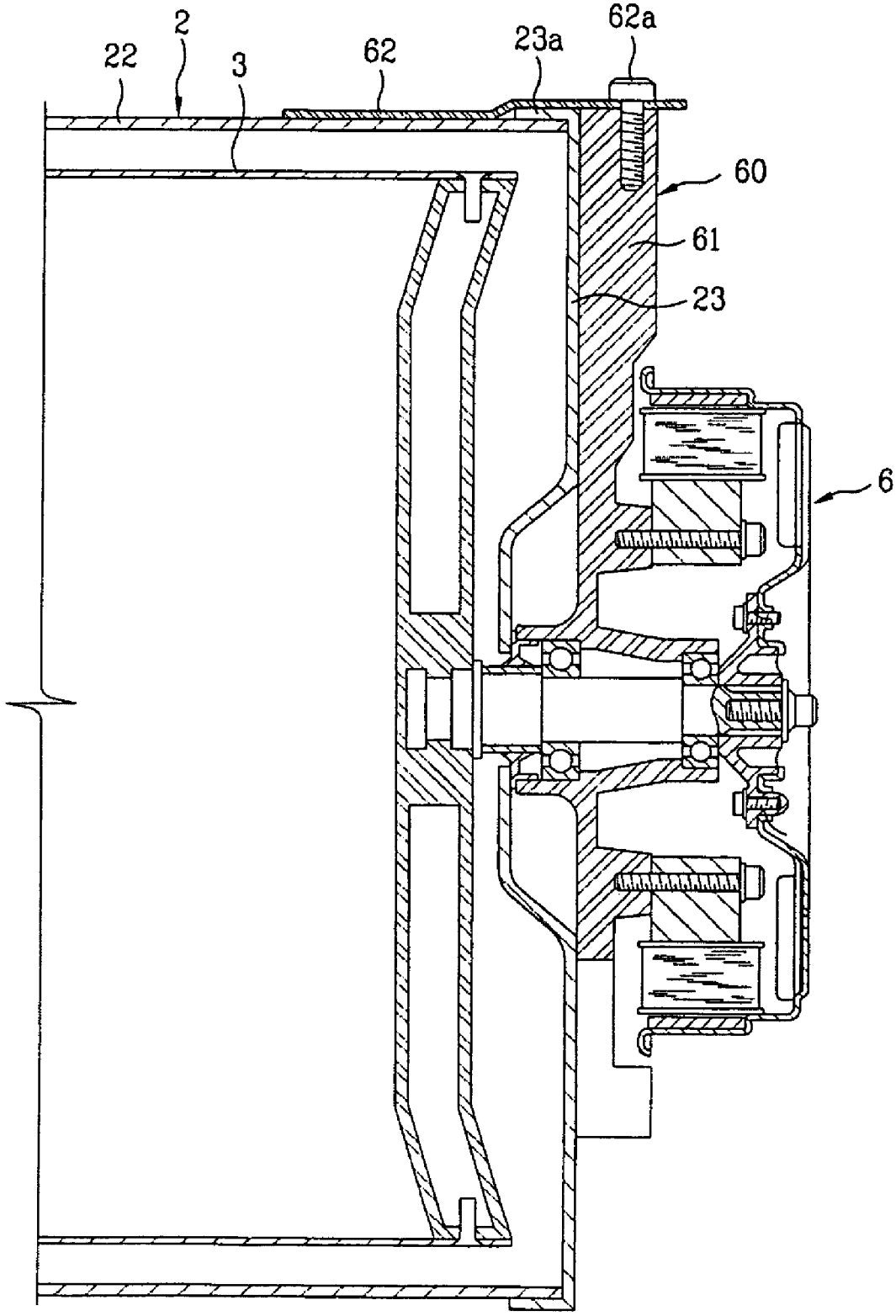
FIG. 2 is a cross-sectional view of a tub of a drum-type washing machine according to a related art, in which a direct-coupled motor is installed at a rear side of the tub.
Figure 3:
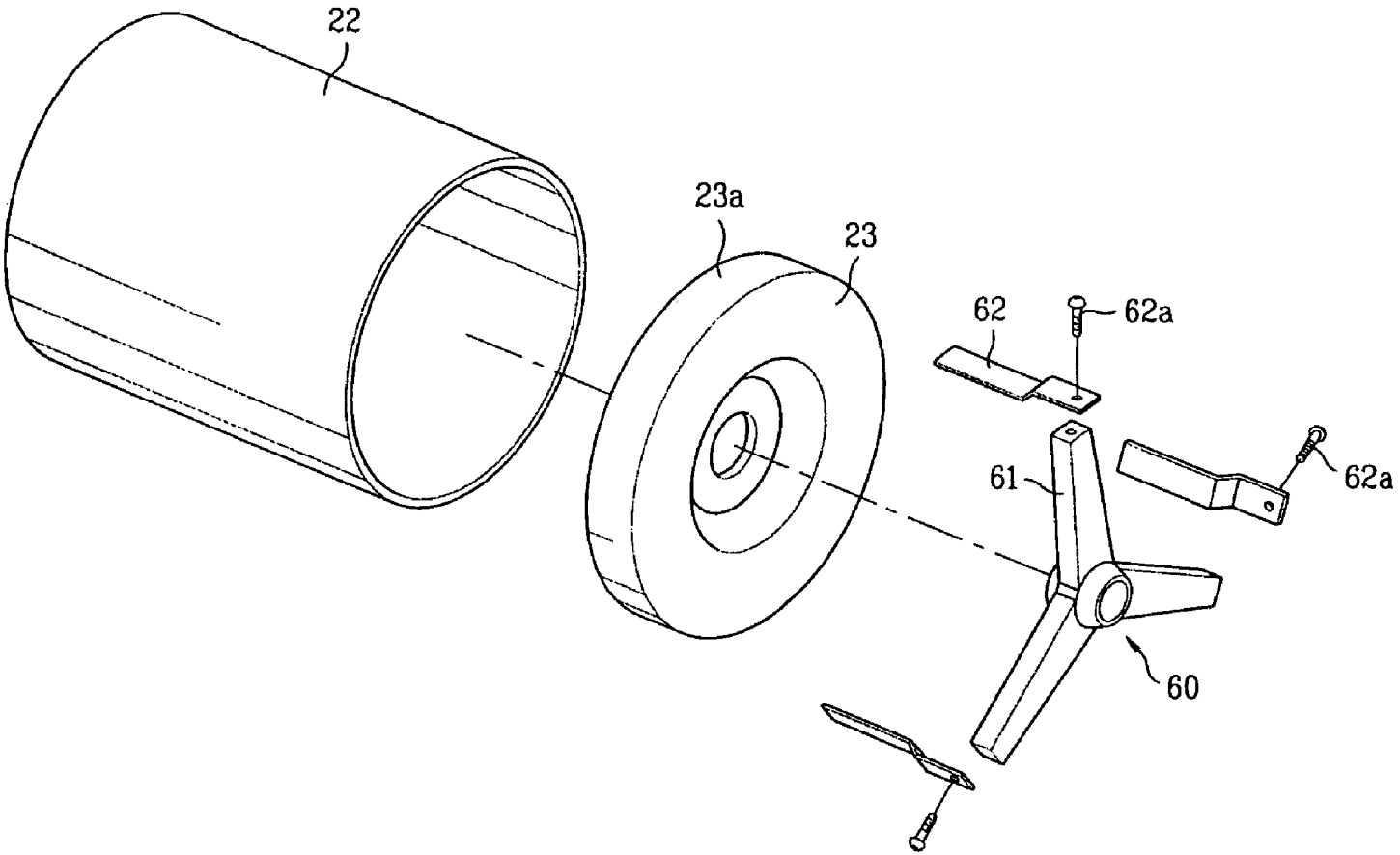
RELATED ART FIG. 3
FIG. 3 is a perspective breakaway view of the tub body and tub back of FIG. 2.
Figure 4:
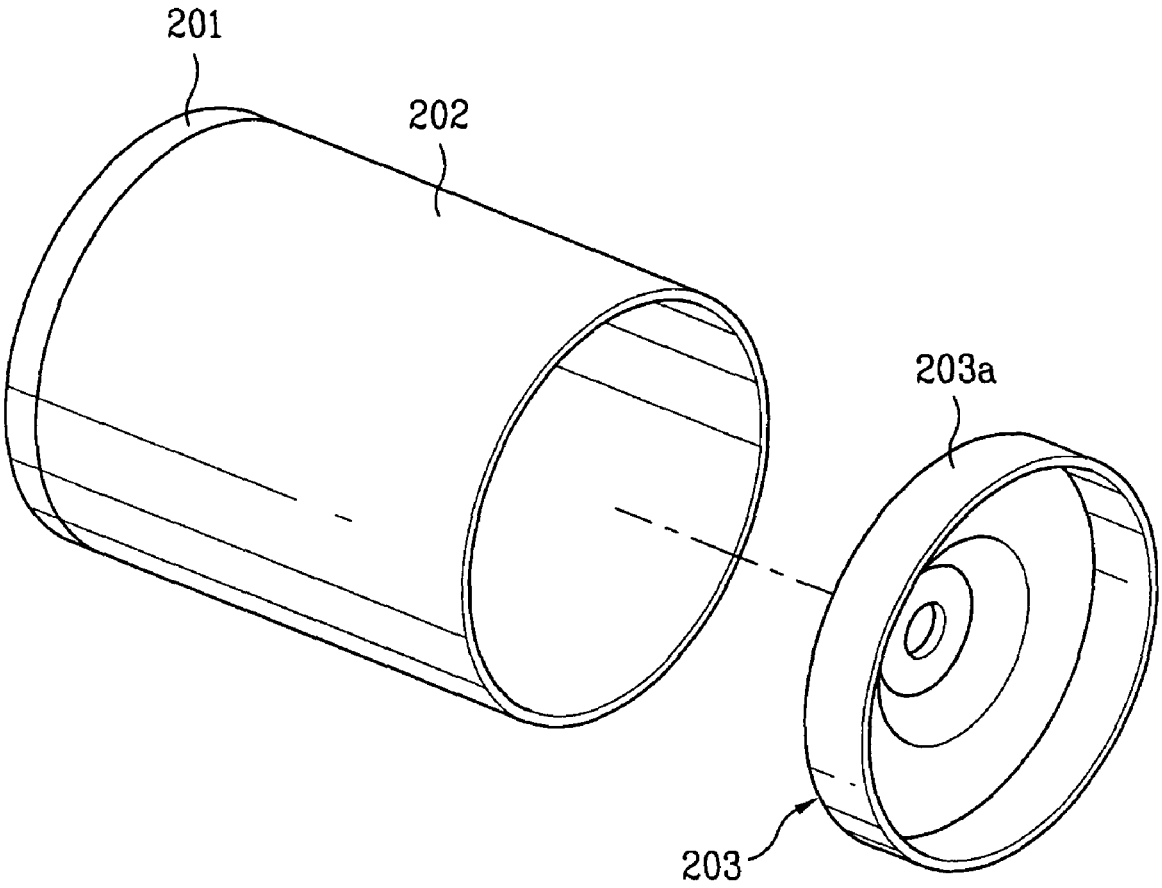
FIG. 4 is a perspective breakaway view of a tub body and a tub back of a tub assembly in a drum-type washing machine according to the present invention.

Referring to FIG. 4, illustrating a tub body and a tub back of a tub assembly in a drum-type washing machine according to the present invention, a tub body 202 is in essence a hollow cylinder and has a ring-type tub cover 201 attached to its front. Though not shown in FIG. 4, a washing vessel (hereinafter referred to as a drum) is positioned inside the tub body 202. A tub back 203 is coupled with a rear side of the tub body 202.

The tub back 203 includes an outer circumference wall 203*a* at the periphery of a circular panel 203*b* having a center hole 203*d*. The outer circumference wall 203*a* extends horizontally, to a predetermined distance, with respect to the circular panel 203*b*. The tub back 203 is formed such that the outer diameter of the tub back including the outer circumference wall 203*a* is equal to, or just slightly less than, the inner diameter of the tub body 202, to establish a tight fit. The center hole 203*d* is provided for receiving a motor shaft 45 of a motor assembly 40 that will be attached to the tub back 203.

Figure 5:
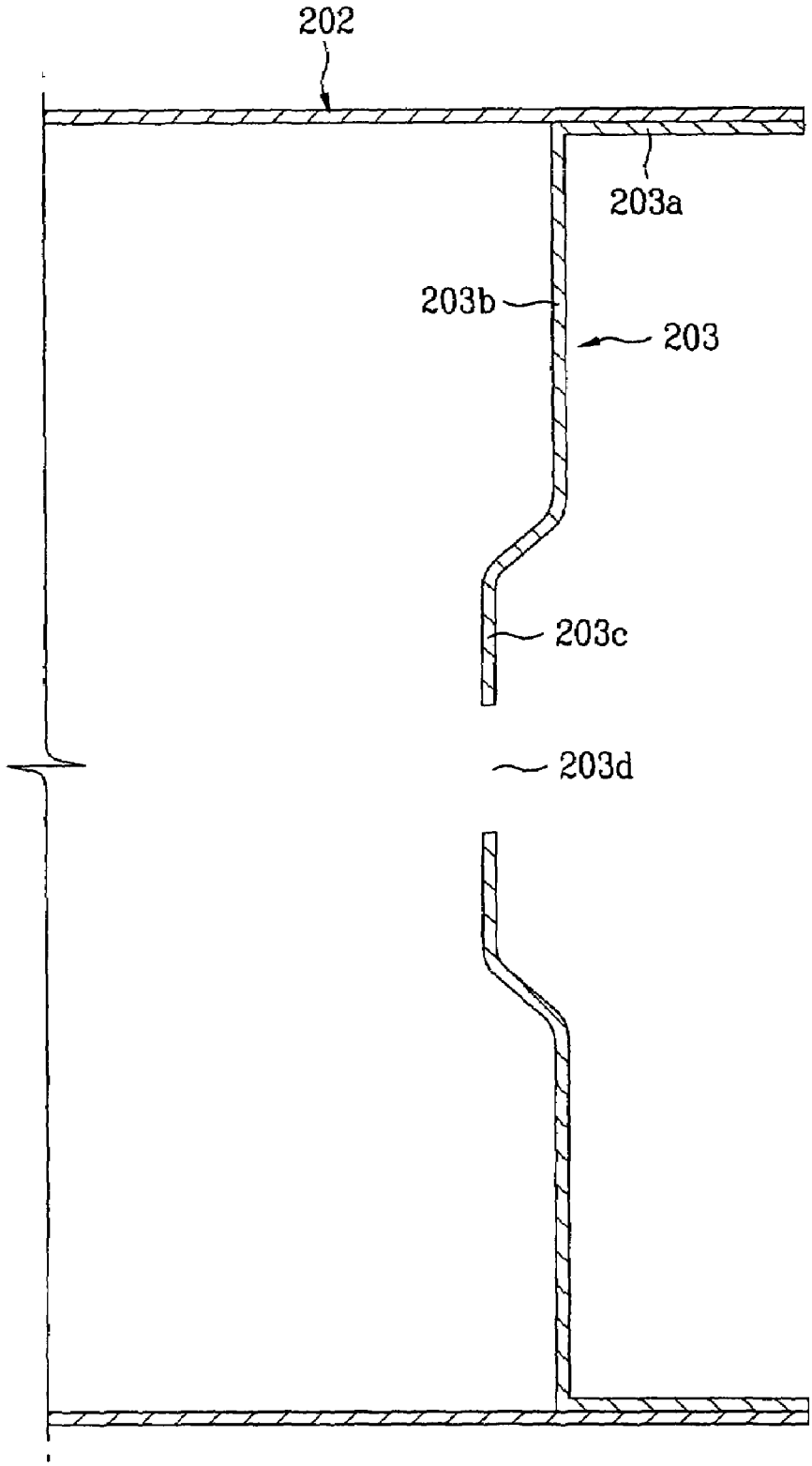
FIG. 5 is a cross-sectional view of a tub body and a tub back of a tub assembly in a drum-type washing machine according to the present invention.

FIG. 5 illustrates an assembly cross-sectional view of a tub body and a tub back according to the present invention, in which the tub back 203 having an outer circumference wall 203*a* is partially inserted inside the tub body 202 through its rear side.

Referring to FIG. 5, the tub back 203 is comprised of a circular panel surface 203*b*, having a recessed surface 203*c*, and an outer circumference wall 203*a*. Here, it is important to note that the tub back 203 is not inserted deep inside the tub body 202, and preferably, the tub back 203 is inserted such that the top edge of the outer circumference wall 203*a* is flush with the rear edge of the tub body 202. Thus inserted, the tub back 203 resides fully inside the tub body 202, whereby a planar portion comprised of surfaces 203*b* and 203*c* is disposed well inside the tub body, and the circular panel surface 203*b* and recessed surface 203*c* create a recessed space at the rear of the tub body, where a motor assembly is to be loaded.

Figure 6:
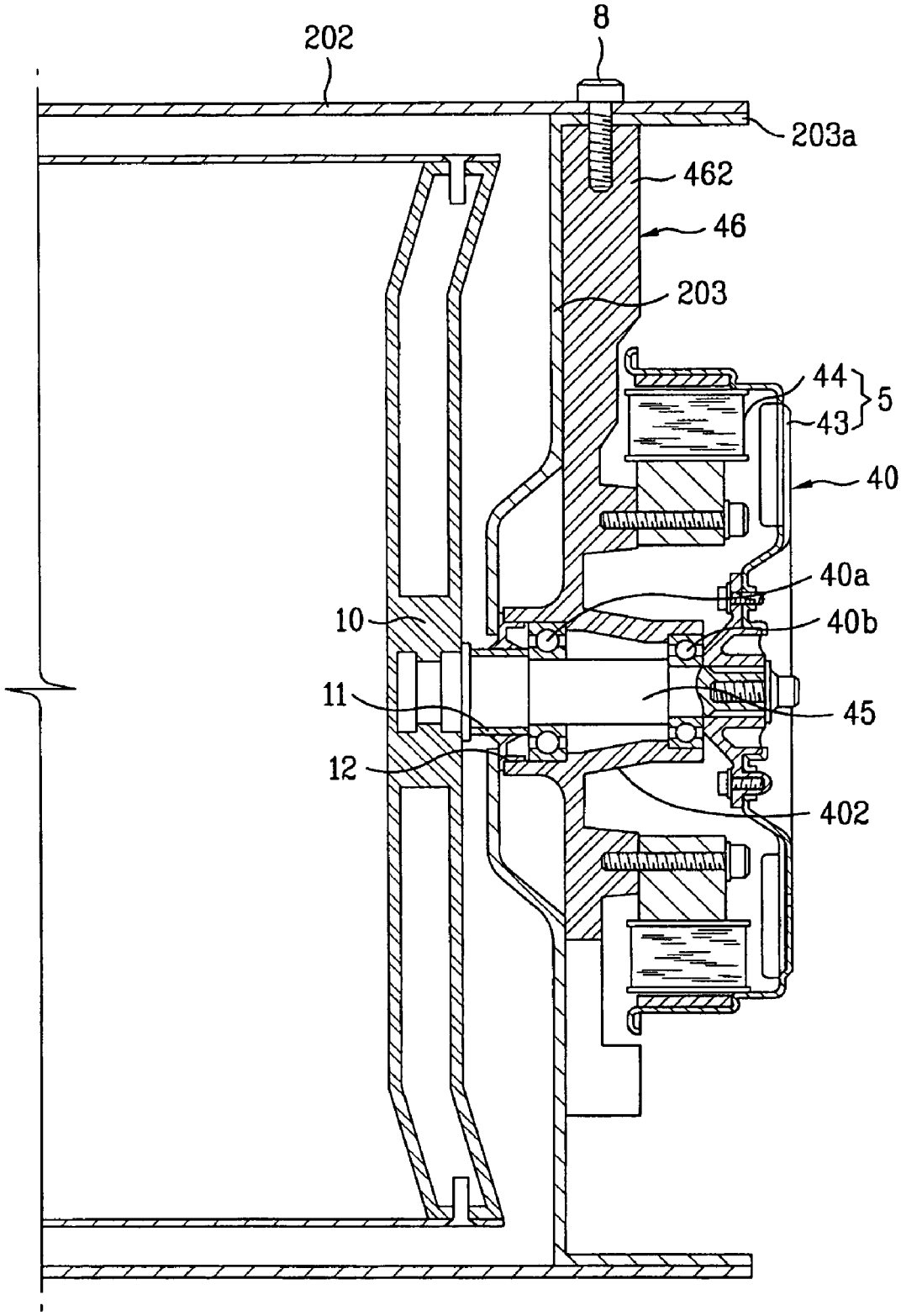
FIG. 6 is a cross-sectional view of a tub assembly in a drum-type washing machine according to the present invention, showing a motor assembly coupled to a tub back of the tub assembly.

FIG. 6 illustrates a tub assembly in a drum-type washing machine according to the present invention, showing a motor assembly 40 installed in the recessed space created by the circular panel surface 203*b* and recessed surface 203*c* of the tub back 203. The motor assembly 40 includes a stator 44 and a rotor 43 that comprise a direct-coupled motor 5 for rotating a drum 3, a shaft 45 connected to the rotor 43 to rotate the drum, bearings 40*a* and 40*b* for supporting revolution of the shaft 45, and a bearing housing 46 for housing the bearings 40*a* and 40*b* and having a three-armed configuration made up of a plurality of bridges 462.

The tub assembly according to the present invention is constructed as follows.

The bearing housing 46 is made of a metal such an aluminum alloy and has an integrally formed hub 402 centrally disposed at the center of the bearing housing. Front and rear bearings 40*a* and 40*b* are embedded in the hub 402 and are supported by step sills provided on an inner circumference of the hub to prevent the bearings from escaping from the bearing housing 46.

The stator 44 is fixed to the bearing housing 46 outside the hub 402 using a coupling member. A forward end of the shaft

45 is coupled with a spider 10 provided at a rear wall side of the drum 3. To prevent corrosion of the shaft 45, a brass bushing 11 covers an exposed portion extending from the rear surface of the spider 10 to the front edge of the front bearing 40*a*. A sealing member 12 is installed around the bushing 11 to prevent water penetration into the bearings.

The rotor 43 is coupled with the rearward end of the shaft 45. The rotator 44, disposed inside the rotor 43, is fixed using a coupling boss of the bearing housing 46.

The bearing housing 46 is loaded on the rear side of the tub back 203. Each bridge 462 of the bearing housing 46 radiates outwardly toward the outer circumference wall 203*a* of the tub back 203. At the point of contact with the outer circumference wall 203*a*, the bearing housing 46 is also coupled to the tub body 202 using a coupling member 8, which is accessible from the exterior of the tub body. The distal end of each bridge 462 is fixed by a single action, which also joins the surface of the outer circumference wall 203*a* of the tub back 203 and the surface of the tub body 202 using, for example, a bolt as the coupling member 8. The three-armed configuration of the bearing housing 46 necessitates at least three coupling members 8.

While the tub back 203 may be attached to the tub body 202 using the coupling member 8 only, it is preferable that an outer surface of the outer circumference wall 203*a* of the tub back 203 and an inner surface of the tub body 202 are welded into each other to prevent a leakage of water from the drum 3.

The tub assembly according to the present invention has no protruding components extending from the rear of the tub body, as in the case of the bearing housing bracket of the related art, thereby enabling a reduction in the tub assembly's diameter and depth. Therefore, a tub and drum of greater volumes can be loaded inside the same-sized cabinet, facilitating the manufacture of a physically smaller drum-type washing machine having greater capacity.

A shorter tub is made possible by the construction of the bearing housing, which protrudes from the rear of the tub in the related art drum-type washing machine, but which is situated within the recessed space of the tub back of the present invention.

In the related art, the bracket protruding from the outer surface of the tub is employed to fix the bearing housing to the tub body and tub back. The present invention, on the other hand, provides for the fixing of the bearing housing without using such a bracket, thereby facilitating the manufacture of a drum-type washing machine having a smaller tub exterior and an exterior having a clean appearance.

The present invention achieves the coupling using a coupling member such as a bolt instead of a bracket, thereby increasing productivity by simplifying the assembly process and shortening the assembly time.

It will be apparent to those skilled in the art that various modifications and variations can be made in the present invention without departing from the spirit or scope of the invention. Thus, it is intended that the present invention cover such modifications and variations provided they come within the scope of the appended claims and their equivalents.

What is claimed is:

1. A tub assembly in a drum-type washing machine, comprising:

a tub body having a cylindrical shape forming front and rear edge portions;

a ring-type tub cover coupled with the front edge portion of the tub body;

a tub back, coupled with the rear edge portion of the tub body, comprised of an outer circumference wall extending horizontally to a predetermined distance with respect to an outer circumference of a circular panel forming a recessed space, the outer circumference wall in tight contact with the rear edge portion of the tub body;

a motor assembly loaded at the recessed space; and a bearing housing, wherein the tub back, the tub body, and the bearing housing are coupled by a coupling member that is coupled with the bearing housing through the rear edge portion of the tub body and the outer circumference of the tub back.

2. The tub assembly as claimed in claim 1, wherein the tub back is weld-coupled with an inner surface of the tub body.

3. The tub assembly as claimed in claim 1, wherein the coupling member is a bolt.

4. The tub assembly as claimed in claim 1, wherein the bearing housing includes a plurality of bridges extending in a radial direction, wherein each bridge is coupled to the tub back and the tub body by the coupling member.

* * * * *